US009608315B2

(12) United States Patent
Gerneth et al.

(10) Patent No.: US 9,608,315 B2
(45) Date of Patent: Mar. 28, 2017

(54) STAR-HANDLE SYSTEM FOR LOCKING ANTENNA TO A VEHICLE ROOF

(75) Inventors: Christian Gerneth, Kirchentellinsfurt (DE); David Silva, Nuertigen (DE)

(73) Assignee: HIRSCHMANN CAR COMMUNICATION GMBH, Neckartenzlingen (DE)

( * ) Notice: Subject to any disclaimer, the term of this patent is extended or adjusted under 35 U.S.C. 154(b) by 472 days.

(21) Appl. No.: 14/003,842

(22) PCT Filed: May 4, 2012

(86) PCT No.: PCT/EP2012/058244
§ 371 (c)(1),
(2), (4) Date: Oct. 24, 2013

(87) PCT Pub. No.: WO2012/150337
PCT Pub. Date: Nov. 8, 2012

(65) Prior Publication Data

US 2014/0043193 A1 Feb. 13, 2014

(30) Foreign Application Priority Data

May 4, 2011 (DE) ..... 10 2011 100 473

(51) Int. Cl.
*H01Q 1/32* (2006.01)
*H01Q 1/12* (2006.01)

(52) U.S. Cl.
CPC ..... *H01Q 1/3275* (2013.01); *H01Q 1/1214* (2013.01)

(58) Field of Classification Search
CPC ..... H01Q 1/3275; H01Q 1/1207
USPC ..... 343/711, 713, 712
See application file for complete search history.

(56) References Cited

U.S. PATENT DOCUMENTS

| | | | | |
|---|---|---|---|---|
| 6,762,727 | B2 * | 7/2004 | Rochford | H01Q 1/1214 24/289 |
| 7,436,367 | B2 | 10/2008 | Blickle | |
| 2005/0237248 | A1 * | 10/2005 | Nakano | H01Q 1/1207 343/711 |
| 2006/0077110 | A1 | 4/2006 | Blickle | |
| 2006/0103579 | A1 | 5/2006 | Blickle | |
| 2007/0120755 | A1 * | 5/2007 | Blickle | H01Q 1/1214 343/713 |
| 2008/0100521 | A1 * | 5/2008 | Herbert | H01Q 1/1214 343/713 |

(Continued)

FOREIGN PATENT DOCUMENTS

| | | | |
|---|---|---|---|
| DE | 10210593 | A | 9/2003 |
| DE | 102005041473 | A | 3/2006 |

(Continued)

*Primary Examiner* — Dameon E Levi
*Assistant Examiner* — Hasan Islam
(74) *Attorney, Agent, or Firm* — Andrew Wilford

(57) ABSTRACT

The invention relates to a roof antenna (1) for mounting on a roof (2) of a vehicle, said roof antenna (1) having a base plate (7) and an antenna cover (3) that can be connected to the base plate (7). A printed circuit board (4) with antenna elements and at least one plug connection (5) is arranged under the antenna cover (3). The base plate (7) has detent hooks (11) for pre-attaching on the roof (2) and fixing means for a final assembly, said fixing means being designed as a central dome (6) with a screw thread and a star handle (12) that interacts with the dome (6).

11 Claims, 4 Drawing Sheets

(56) References Cited

U.S. PATENT DOCUMENTS

| | | | | |
|---|---|---|---|---|
| 2011/0084191 | A1 | 4/2011 | Lerchner | |
| 2011/0133047 | A1 | 6/2011 | Lerchner | |
| 2011/0267243 | A1* | 11/2011 | Steinkamp ..... | H01Q 1/1214<br>343/713 |

FOREIGN PATENT DOCUMENTS

| | | | |
|---|---|---|---|
| DE | 102012202677 | A | 8/2012 |
| EP | 2276111 | A | 1/2011 |
| WO | 2006108589 | A | 10/2006 |

* cited by examiner

STAR-HANDLE SYSTEM FOR LOCKING ANTENNA TO A VEHICLE ROOF

CROSS REFERENCE TO RELATED APPLICATIONS

This application is the US-national stage of PCT application PCT/EP2012/058244 filed 4 May 2012 and claiming the priority of German patent application 102011100473.8 itself filed 4 May 2011.

FIELD OF THE INVENTION

The invention relates to a roof antenna for installation on a roof of a vehicle and comprising comprises a base plate and an antenna cover that can be attached to the base plate as well as a circuit board including antenna elements and at least one plug connector under the antenna cover, the base plate having detent tabs for preattachment to the roof and an attachment for final installation.

BACKGROUND OF THE INVENTION

A wide variety of embodiments of a roof antenna and corresponding methods for installing this type of roof antenna on the roof of a vehicle have been disclosed (for example in DE 10 2005 041 473, U.S. Pat. No. 7,436,367, or US 2006/0077110).

The generic reference DE 10 2012 202 677.0, which has not been published, discloses a roof antenna for installation on a roof of a vehicle, where the roof antenna comprises a base plate and an antenna cover that can be attached to the base plate, and where a circuit board including antenna elements and at least one plug connector is under the antenna cover. In order to facilitate installation, the prior art discloses an approach whereby detent tabs are provided that enable the roof antenna to be premounted on the roof after the roof antenna has been inserted in a vertically downward direction with its fastening section through an opening in the roof of the vehicle. Once the roof antenna is in this preinstallation position, additionally attachments are actuated in order to permanently affix the roof antenna, provide a seal, and secure it immovably at the desired location on the roof of the vehicle.

OBJECT OF THE INVENTION

The object of this invention is therefore to improve this generic roof antenna with regard to its installation method and its configuration, in particular, with the aim of further simplifying its installation.

SUMMARY OF THE INVENTION

This object is achieved the attachments are provided in the form of a central threaded pivot pin that projects into the interior of the vehicle and a star handle that interacts with the pivot pin after the roof antenna has been mounted in its preinstallation position. This star handle, which in an especially advantageous embodiment includes precisely four arms extending at right angles to each other, is located initially in a preinstallation position. This means that the star handle is mounted in such a way relative to the roof antenna and also relative to the roof opening so as to allow it to be passed together with its attachments vertically from above toward the interior. This means that the roof antenna—or more precisely, its base plate or a seal mounted on the base plate or other elements—comes to rest on the upper face of the roof, and that it then becomes possible to manipulate the star handle to enable it to be moved from its preinstallation position (preattachment) to its final installation position after it has been preattached by the detent tabs that also project vertically downward through the roof opening. In other words, the roof antenna is placed from above onto the roof and passed together with its detent tabs and attachments through the roof opening. Once the roof antenna has come to rest on the upper face of the roof such that preattachment has been effected by the detent tabs, the attachment, that is, the star handle, can be manipulated to mount the roof antenna in its final position on the roof of the vehicle in a permanent, perfectly positioned, and immovable manner. The rotation of the star handle on the threaded central pivot pin has the advantage of allowing fast installation to be effected, optionally without tools. In addition, the force with which the base plate comes to rest on the vehicle roof can be adjusted very precisely by rotating the star handle. This is advantageous, in particular, if a seal is provided between the lower face of the base plate and the top surface of the roof. This effectively allows the seal to optimally perform its seal function, thereby avoiding a situation in which the sealing function is not sufficient due to inadequate compression of the seal, or also is not optimal due to excessive compression. The advantage is furthermore provided that any tolerances can be compensated for, in particular, in the varying thickness of the roof. As a result, the roof antenna according to the invention also allows for very flexible installation in different vehicles with various roof thicknesses.

In a development of the invention, the star handle is provided in such form as to allow it to be passed with the ends of the arms in a preinstallation position vertically through an opening in the roof, then gripping by the arm ends under the lower face of the roof in its final installation position. Fastening the roof antenna to the roof of a vehicle by the arm ends of the star handle enables a very good lever action to be achieved, thereby resulting in a strong force by which the antenna is fastened to the roof of the vehicle. The sides and/or surfaces of these arm ends facing the lower face of the roof can be beveled so as to facilitate installation. It is furthermore possible for the surface of the star handle facing toward the lower face of the roof to include tangs, ridges, or the like when the handle is in its final installation position. Even if the star handle and the central pivot pin are composed of an electrically conductive material, these means can also function to effect the ground connection for the roof antenna even if the vehicle roof is also composed of a metallic material. If these elements are not composed of a metallic material, an approach can be considered whereby the ground connection is implemented using other elements, for example, plug connectors.

In a development of the invention, at least one stop is provided on the base plate to limit the angle of rotational travel of the star handle. This at least one stop, preferably one limit stop for the preinstallation position and one limit stop for the final installation position, has the advantage of delimiting a range of motion for the star handle to facilitate installation of the roof antenna. The star handle is thus especially advantageously moved only between these two stops that define the respective starting position and end position. As a result, the mounting torque of the roof antenna on the roof of the vehicle can also be set at a predefined value.

In a development of the invention, at least one guide rib is provided on the base plate, preferably, two opposing guide ribs or two guide ribs that are oriented at right angle to each other. These guide ribs that point vertically downward from the base plate, that is, toward the roof opening of the vehicle, have the advantage of matching the shape of the roof opening, and provide guidance and alignment for the roof antenna both during preinstallation and final installation. This at least one guide rib is advantageously integrated as one piece with the base plate (for example, guide rib and base plate are composed of a plastic injection-molded unit) or are additionally either detachably or permanently joined to the base plate.

In a development of the invention, the star handle in its preinstallation position covers the at least one plug connector, then exposes it in the final installation position. A critical advantage here is the fact that the star handle is moved to a preinstallation position whereby preferably each one of its arms covers one plug connector. In this delivery configuration of the roof antenna, the plug connectors are protected against being damaged or contaminated, the plug connectors typically being provided in the form of female sockets. It is only after the roof antenna has been fastened in a preattached manner to the roof and the star handle has been moved from its preinstallation position to its final installation position for final installation that the star handle exposes the at least one plug connector, thereby enabling the plug connector of the roof antenna to be plugged into the mating plug connector, for example, at the end of a cable when the roof antenna has been permanently mounted to the roof of the vehicle in its specified position.

SPECIFIC DESCRIPTION OF THE INVENTION

Figure 1A:
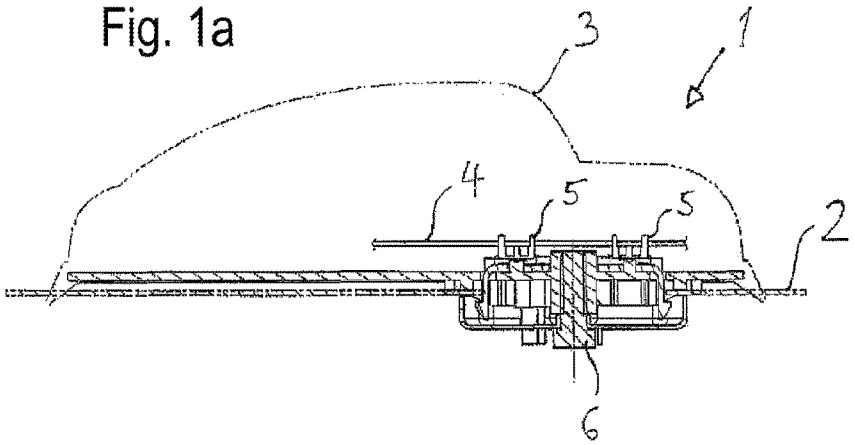
FIG. 1*a* is a vertical section through an antenna according to the invention installed in a vehicle roof.
Figure 1B:
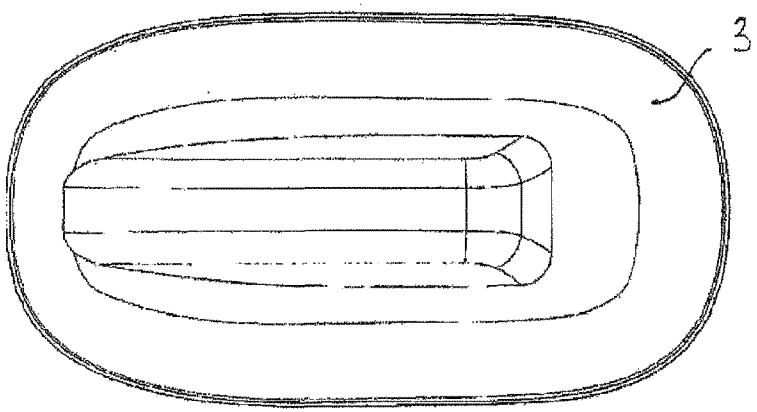
FIG. 1*b* is a top view of the structure of FIG. 1*a*, line Ia-Ia indicating the section of FIG. 1*a;*
Figure 1C:
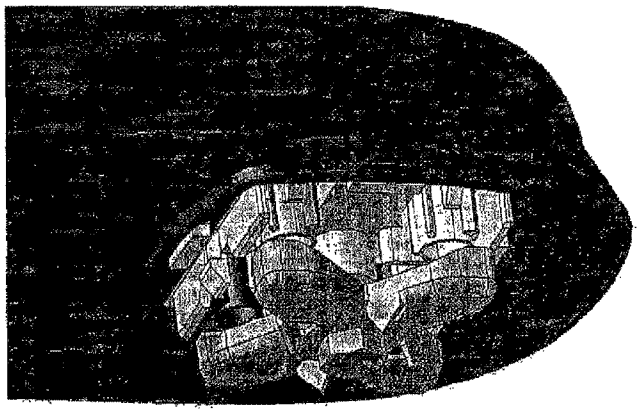
FIG. 1*c* is a bottom perspective view of the antenna in the condition it is in when delivered to the installer.

FIGS. 1*a* through 4*b* are, to the extent details are illustrated, different views of a roof antenna 1 to be installed on a roof 2 of a vehicle. FIG. 1*a* shows the antenna 1 installed in on the roof 2. In terms of function, this antenna 1 comprises an antenna cover 3, where, for example, a circuit board 4 including unillustrated antenna elements (for example, for telephone, GPS, TV, and the like) are accommodated under the cover 3. This circuit board 4 can include downwardly directed plug connectors 5 (or also only one plug connector), although it does not necessarily have to include the at least one plug connector. Establishing the connections of the antenna elements under the cover 3 to attached electronic devices can also be effected by other means, such as, for example, cables. In addition, a central pivot pin 6 is shown in this view. In FIG. 1*b*, the antenna 1 is viewed from above, while in FIG. 1*c* it is seen from below, the following discussion referencing FIGS. 2 through 4*b* in explaining the constructive design of the antenna 1 according to the invention and its installation on the roof 2.

In addition to the elements already described and shown in FIGS. 1*a-c*, FIG. 2 shows a base plate 7 of the antenna 1, the plate 7 including counter-supports 8 projecting downward. In this embodiment, the counter-supports 8 define the spacing between the lower face of the base plate and the top face of the roof 2. The counter-supports 8, for example, can be annular or alternatively can be omitted. An inner seal 9 is furthermore provided that is between the lower face of the base plate and the upper face of the roof 2. This inner seal 9 can also be annular so as to effect a sealing function between the exterior surrounding the antenna 1 and the interior of the vehicle. An outer seal 10 can be provided as an alternative to or in addition to the inner seal 9, the outer seal 10 sealing between the circumferential lower edge of the cover 3 and the upper face of the roof 2.

Figure 2:
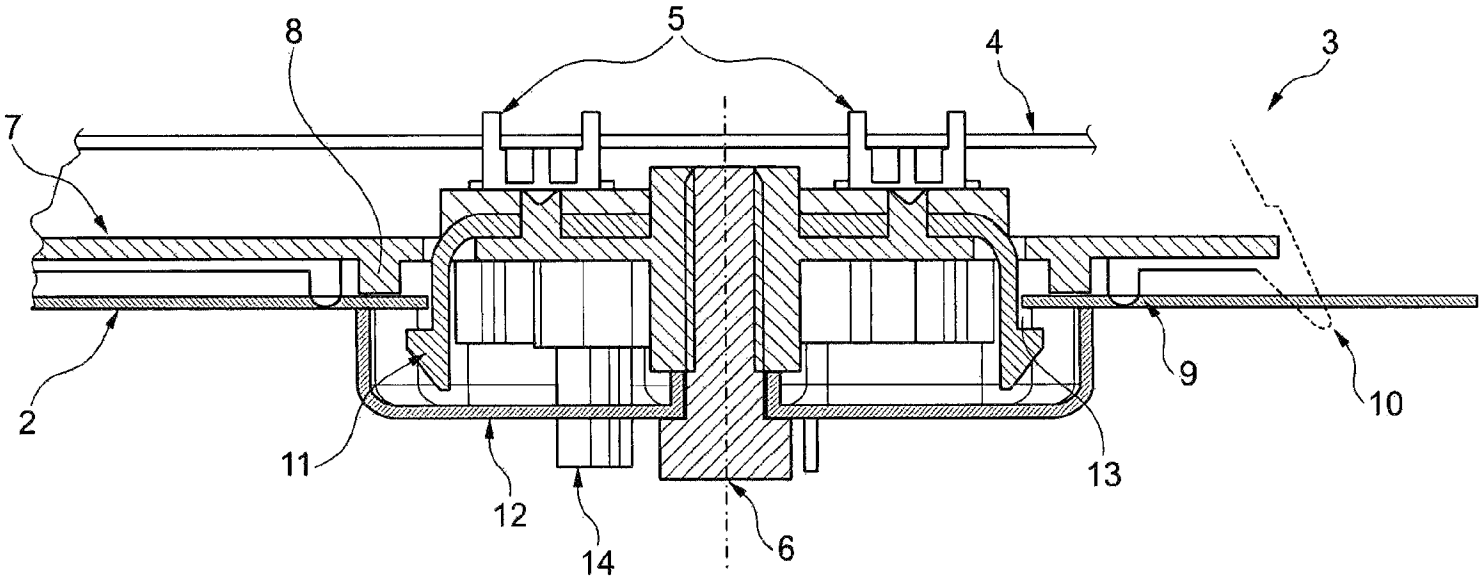
FIG. 2 is a large-scale view of a detail of FIG. 1*a;*

Detent tabs 11 are provided to preattach the antenna 1 to the roof 2. A star handle 12 is provided for final installation of the antenna 1 on the roof, the star handle being located on the central threaded pivot pin 6. This embodiment in FIG. 2 already shows that the antenna 1 has been mounted in its final position on the roof 2. This is effected by passing the antenna 1 from above through an opening 13 in the roof 2 with its fastening section. This establishes a preinstallation position to be assumed by the detent tabs 11. If counter-supports 8 are provided, their axial height is selected or the length of the detent tabs extending downward is also selected so as to enable the detent tabs to always grip behind the lower face of the roof before the lower faces of the counter-supports comes to rest on the upper face of the roof 2. Only when the antenna 1 has reached this preinstallation position in which the antenna is fastened essentially immovably to the roof 2 is the star handle 12 manipulated, and the antenna 1 then mounted in its final position securely, permanently, as well as immovably, but optionally detachably, to the roof 2 of the vehicle. FIG. 2 furthermore already shows at least one stop 14, preferably multiple stops that will be explained in more detail below.

Figure 3B:
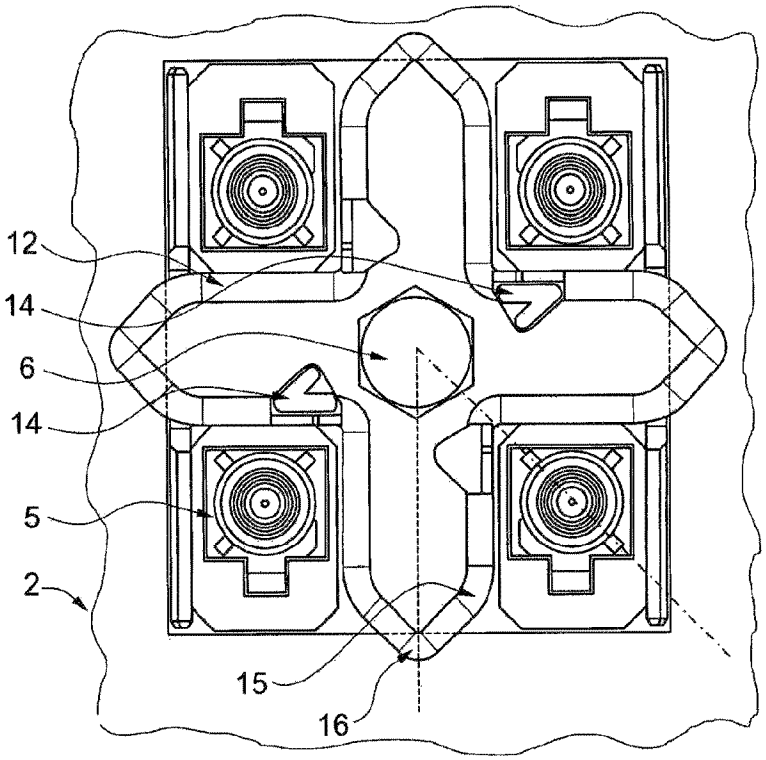
FIGS. 3*a* and 3*b* are bottom views of the antenna according to the invention in the installed and ready-to-install or delivered condition.
Figure 3A:
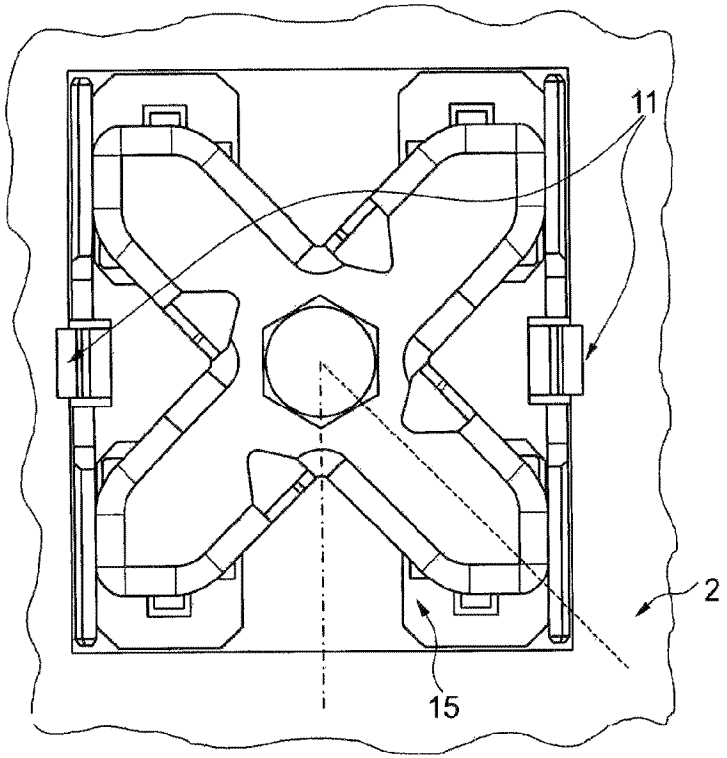
Figure 4B:
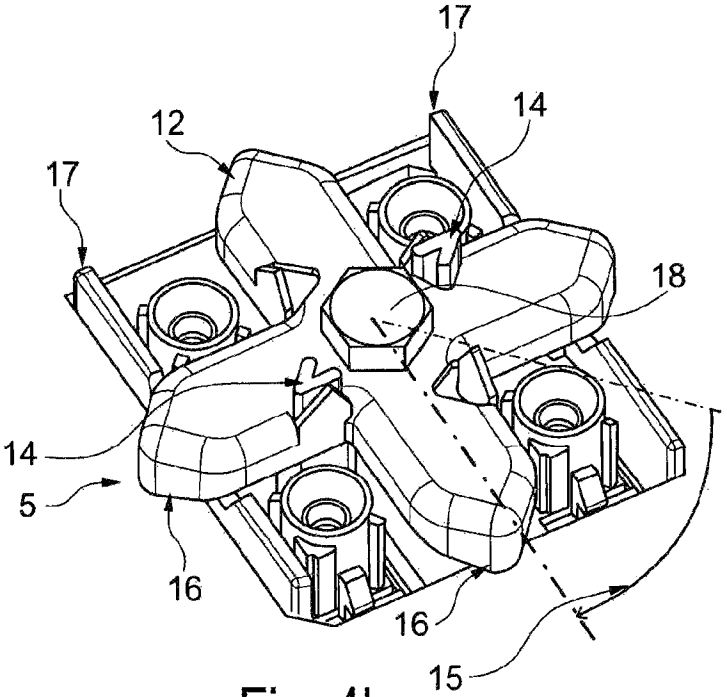
FIGS. 4*a* and 4*b* are bottom perspective views corresponding to respective FIGS. 3*a* and 3*b*.
Figure 4A:
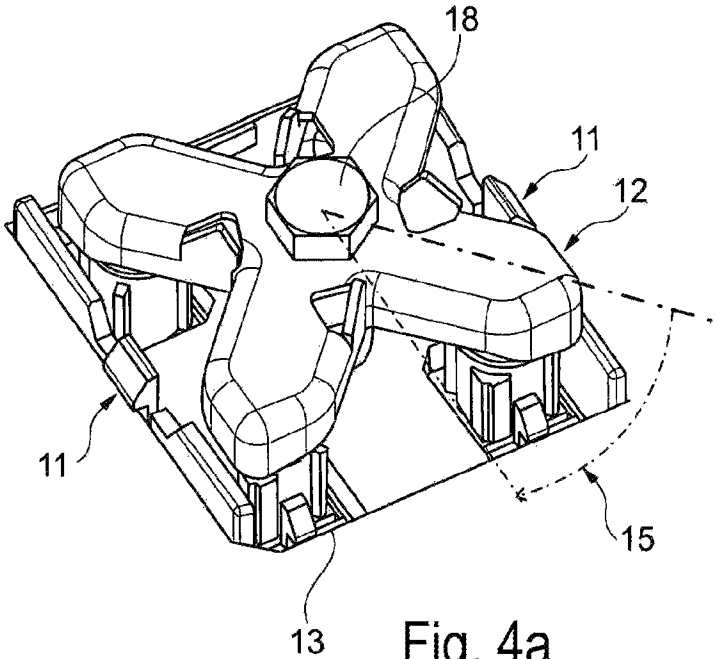

FIGS. 3*a-b* and 4*a-b* provide elevational (FIGS. 3*a-b*) and perspective (FIGS. 4*a-b*) views of the antenna 1 with its fastening section as seen from below, that is, as viewed from inside the vehicle looking toward the lower face of the roof 2. In these views, FIGS. 3*a* and 4*a* show the preinstallation position (or what is known as the delivery position in which the roof antenna is delivered by a supplier to the automobile manufacturer), while FIGS. 3*b* and 4*b* show the final installation position. These views from below clearly show stops 14 that function to define a angle 15 of rotational travel 15 of the star handle 12. This means that the star handle 12 cannot be rotated counterclockwise in FIGS. 3*a* and 4*a* in its delivery position. This is possible only by rotating the star handle 12 clockwise around the central pivot pin. This rotation can be continued until each arm of the star handle 12 contacts its respective stop 14. In other words, the angle 15 of rotational travel of the star handle 12 in this embodiment is especially advantageously a maximum of 45° when the star handle moves from its preinstallation position to the final installation position. If the stops 14 are not present, or if, for example, only a single stop 14 is provided, the angle 15 of rotational travel of the star handle 12 can of course be greater. This angle can also be less than 45° and also greater than one revolution. Effecting more than one revolution of the star handle 12 about the central pivot pin 6 enables greater tolerances or different roof thicknesses to be compensated for, as described above.

It is also evident that the arms of the star handle 12 each have one end 16 and that the star handle 12 can be passed with the arm ends 16 through the roof opening 13, and the arm ends 16 of the star handle 12 grip behind the lower face of the roof 2 after the star handle has been rotated. When the star handle 12 is in the position shown in the FIGS. 3*b* and 4*b*, the antenna 1 is thus permanently mounted on the roof 2 of the vehicle. In addition, FIGS. 3*a-b* and 4*a-b* show at least one guide rib—here at least two opposite guide ribs 17. The position of the guide ribs 17 on the base plate as well as the length of the guide ribs 17 match the shape of the roof opening 13, thereby enabling the roof antenna to be aligned and mounted in its specified position on the roof 2. At the same time, the shape (cutout) of roof opening 13 and the shape of the guide ribs (configuration, length, and the like) are selected in such a way that the antenna 1 can be passed through the roof opening 13, preattached, and finally attached only in a single position, that is, in its specified position.

Finally, FIGS. 3*a-b* and 4*a-b* show the advantageous design of the star handle 12 whereby it covers the at least one plug connector 5 (FIGS. 3*a* and 4*a*) in the preinstallation position is (delivery position), and exposes the plug connector 5, or here exactly four provided plug connectors 5, when in the final installation position (installed position; FIGS. 3*b* and 4*b*).

The star handle 12 is designed to be manipulated by hand without tools. However, a possible approach that also can be considered is one where the star handle includes means, in particular, a hexagonal projection 18 allowing it to be manipulated by a tool. In addition, means are especially advantageously provided to arrest the star handle 12 in the preinstallation position (delivery position). This ensures that the arms of the star handle 12 cover each plug connector 5 until the antenna 1 has been installed on the roof of the vehicle.

The invention claimed is:

1. In combination with a motor-vehicle roof having a lower roof face and an outer upper roof face and a throughgoing hole of a predetermined shape, an antenna comprising:

a base plate adapted to rest on the upper roof face;

a circuit board and antenna element on the base plate;

a cover secured to the base plate and containing the board and antenna element with the base plate;

a pivot pin projecting from the base plate and extending, when the base plate is resting on the upper roof face, downward through the hole; and a star handle having arms and of a shape capable of passing through is the hole only in a preinstallation position of the star handle relative to the hole, the star handle being pivotal, when the base plate is resting on the upper roof face and the arms are below the lower roof face, between the preinstallation position and a final installation position angularly offset therefrom with ends of the arms movable upward into engagement with the lower roof face around the hole.

2. The roof antenna according to claim 1, further comprising:

an element threaded into the base plate, bearing upward on the star handle, and rotatable for pressing the ends of the star handle against the lower roof face in the installation position of the star handle.

3. The roof antenna according to claim 1, further comprising:

at least one stop on the base plate limiting an angle of rotational travel of the star handle to movement between the reinstallation and final installation positions.

4. The roof antenna according to claim 1, further comprising:

at least one guide rib on the base plate and generally complementary to the roof hole so as to fit therethrough.

5. The roof antenna according to claim 1, wherein the star handle covers at least one plug connector in its preinstallation position, and exposes the plug connection in it's the final installation position.

6. The roof antenna according to claim 1, wherein the star handle includes means for manipulation of the star handle by a tool.

7. The roof antenna according to claim 1, wherein the star handle includes means for releasably retaining it in the preinstallation position.

8. The roof antenna according to claim 1, wherein the star handle has exactly four arms extending at right angles to each other.

9. The roof antenna according to claim 8, wherein an angle of rotational travel of the star handle between the preinstallation position and the final installation position is at most 45°.

10. The roof antenna according to claim 9, wherein the angle of rotational travel of the star handle is limited by at least one counter-support that can be contacted with the surface of the roof and is on the base plate when the star handle moves from the preinstallation position to the final installation position.

11. The roof antenna according to claim 8, wherein the roof hole is of generally square shape and in the preinstallation position the arms of the star handle extend angularly toward corners of the roof hole.

* * * * *